US006344090B1

(12) United States Patent
Johnston

(10) Patent No.: US 6,344,090 B1
(45) Date of Patent: Feb. 5, 2002

(54) METAL LOSS INHIBITORS AND PROCESSES THEREWITH

(75) Inventor: William G Johnston, Allen Park, MI (US)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 09/381,421

(22) PCT Filed: Mar. 19, 1998

(86) PCT No.: PCT/US98/03806

§ 371 Date: Sep. 20, 1999

§ 102(e) Date: Sep. 20, 1999

(87) PCT Pub. No.: WO98/41606

PCT Pub. Date: Sep. 24, 1998

Related U.S. Application Data

(60) Provisional application No. 60/040,809, filed on Mar. 18, 1997.

(51) Int. Cl.[7] ..... C23G 1/04

(52) U.S. Cl. ..... 134/2; 134/3; 134/22.16; 134/22.17; 134/22.19; 134/26; 134/30; 134/36; 134/41; 510/247; 510/249; 510/253; 510/263; 510/421; 510/487

(58) Field of Search ..... 510/247, 249, 510/253, 263, 421, 487; 134/2, 3, 22.16, 22.17, 22.19, 26, 30, 36, 41

(56) References Cited

U.S. PATENT DOCUMENTS 2,758,970 A 8/1956 Saukaitis et al. ..... 252/8.55
3,639,279 A * 2/1972 Gardner et al. ..... 252/86
3,668,137 A * 6/1972 Gardner ..... 252/149
3,932,296 A * 1/1976 Byth ..... 252/148
3,992,313 A * 11/1976 Anderson et al. ..... 252/149
4,120,654 A * 10/1978 Quinlan et al. ..... 422/16
4,381,950 A * 5/1983 Lawson ..... 134/3
4,541,945 A * 9/1985 Anderson et al. ..... 252/149
4,873,014 A * 10/1989 Long ..... 252/148
5,135,610 A * 8/1992 Tytgat et al. ..... 154/664
5,171,477 A * 12/1992 Kreh ..... 252/389.23

OTHER PUBLICATIONS

"Chemical Cleaning Research for Nuclear Steam Generators", Proceedings of the 32nd International Water Conference (Engineers Society of Western Pennsylvania, Pittsburg, 1972), S. Pocock and W. S. Leedy, pp. 67–79.

"Inhibition of Carbon Steel Corrosion in Chemical Cleaning Solutions Containing Solid Magnetite", *Corrosion—NACE*, 1983, R. Roberge and R. Gilbert, pp. 496–501.

* cited by examiner

*Primary Examiner*—Sharidan Carrillo
(74) *Attorney, Agent, or Firm*—Wayne C. Jaeschke; Stephen D. Harper

(57) ABSTRACT

An inhibitor especially useful for aqueous solutions being used at high temperatures to remove scale from boiler tubes and the like contains (1) amines including a substituent group with an abietyl nucleus, (2) organic compounds or polymers that contain at least 2—OH moieties per molecule and at least 0.4 —OH moieties per carbon atom, (3) organic molecules that contain a carbon-sulfur bond, and (4) surfactant.

20 Claims, No Drawings

METAL LOSS INHIBITORS AND PROCESSES THEREWITH

CROSS-REFERENCE TO RELATED APPLICATIONS

This application is filed under 35 U.S.C. §371 and claims the benefit of International Application No. US98/03806, filed Mar. 19, 1998, and claims the benefit under 35 U.S.C. §119(e) of U.S. Provisional Application No. 60/040,809, filed Mar. 18, 1997.

BACKGROUND OF THE INVENTION

1. Field of the Invention

This invention relates to the cleaning of ferriferous metal surfaces with alkaline aqueous solutions to remove scale and like materials from the surfaces. The cleaning solutions in question contain organic molecules that contain at least two —OH moieties (which may or may not be part of carboxyl or phosphonyl moieties) positioned within the molecule in such a way that the two oxygen atoms are separated from each other by at least two carbon atoms and therefore can readily form sterically unstrained ring structures with at least five atoms per ring, by chelating coordinate bonding to an iron cation.

2. Statement of Related Art

The word "scale" when used herein includes any solid deposit formed on a solid ferriferous metal surface as a result of contact between the metal surface and an aqueous solution in liquid or vapor state. The formation of such scale is a notorious problem in boiler and heat exchanger tubes through which large volumes of aqueous solutions flow and are subjected to temperature variations. These temperature variations can cause solutes in the aqueous solution to become less soluble, can evaporate some of the water in the aqueous solution, and/or can promote chemical reactions within the aqueous solution. All of these possible actions can convert some of the solute in an aqueous solution at one temperature to change to a solid phase at a different temperature and thereby cause deposits of scale. Metal surfaces which these aqueous solutions contact are often a major source of the temperature variations to which the aqueous solutions are subjected, and scale frequently forms on the metal surfaces as a result. Even a thin layer of scale can substantially impede heat transfer from a metal surface to a liquid in contact with it, and if left untreated, scale will eventually completely plug at least some of the passageways through which the scale forming aqueous solution(s) previously flowed.

Accordingly, it is well established practice to clean scale from metal surfaces in industrial process equipment through which large volumes of dilute aqueous solutions, economically valued primarily for their water content, regularly pass. This is particularly true for the very large volume electric power industry, which makes extensive use of cooling water in such equipment during the generation of electricity from either fossil fuel or nuclear reaction.

It is strongly preferred to use a cleaner that dissolves the scale to be removed, rather than merely dislodging it and relying on mechanical motion to remove the still solid but now suspended particles that formerly constituted the scale from what are often narrow passageways. For this and other reasons, the most preferred cleaning solutions for cleaning scale from heat exchanger and/or boiler surfaces are aqueous solutions that include chelating molecules as described above. The cleaning solutions, usually have a pH value between about 6 and 10. The molecules that chelate iron cations are usually also capable of chelating the metal ions in some of the most common constituents of scale, particularly calcium and magnesium sulfates and carbonates. In part because of the presence of these chelating constituents, the commonly used cleaning solutions, unless inhibited, are often capable of unwanted dissolution of underlying ferriferous metal along with their desired dissolution of the scale adhering to the metal.

Advantageous inhibitors reduce the rate of dissolution of clean metal as much as possible while reducing the rate of dissolution of surface scale and like contaminating materials as little as possible. One common quantitative method of rating inhibitors used in the art, and in this description below, involves measuring the corrosion rate of the metal to be cleaned in a solution containing the type and concentration of other solutes to be used for cleaning, measuring the corrosion rate in a solution otherwise the same except for adding the inhibitor to be used, and then reporting the results as the percent "protection" of the inhibitor. The percent protection is defined by the following equation: $P=100[1-(R_i/R_u)]$, where P=percent protection, $R_i$=corrosion rate of the metal in the inhibited solution, and $R_u$=the corrosion rate of the metal in the uninhibited solution containing the same constituents, except for inhibitor, as the inhibited solution. (The corrosion rates for $R_u$ and $R_i$ should of course be in the same units when this calculation is made.)

A variety of inhibitors for neutral to alkaline chelating cleaning solutions are known in the art, but none have been found completely satisfactory for all applications.

DESCRIPTION OF THE INVENTION

Objects of the Invention

A major object of this invention is to provide inhibitors and inhibited neutral to alkaline chelating aqueous solutions that provide greater percent protection values to at least one type of ferriferous metal than is provided by any prior art inhibitor. Other concurrent or alternative objects are: to provide effective inhibition at low cost, particularly by utilizing combinations of ingredients that are more effective than any single ingredient in the combination would be alone, or in other words, are synergistic; and to avoid carcinogens and/or otherwise toxic ingredients. The desired freedom from carcinogens includes freedom from carcinogenic products formed by reaction among the components of the inhibitor within 1000 hours of mixing, as well as freedom from known carcinogens directly added to the inhibitor mixtures. Other objects will appear from the description below.

General Principles of Description

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred, however. Also, unless expressly stated to the contrary: percent, "parts of", and ratio values are by weight; the term "polymer" includes "oligomer", "copolymer", "terpolymer", and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description or of generation in situ within the composition by chemical reaction(s) noted in the specification between one or more newly added constituents and one or more constituents already present in the composition when the other constituents are added, and does not necessarily preclude unspecified chemical interactions among the constituents of a mixture once mixed; specification of materials in ionic form implies the presence of sufficient counterions to produce electrical neutrality for the composition as a whole; any counterions thus implicitly specified preferably are selected from among other constituents explicitly specified in ionic form, to the extent possible; otherwise such counterions may be freely selected, except for avoiding counterions that act adversely to the objects of the invention; and the terms "solution", "soluble", and the like are to be understood as including not only true equilibrium solutions but also dispersions that show no visually detectable tendency toward phase separation over a period of observation of at least 1000 hours.

SUMMARY OF THE INVENTION

It has been found that particularly effective inhibition of chelating aqueous neutral to alkaline solutions can be achieved by use of an inhibitor that comprises, preferably consists essentially of, or more preferably consists of the following components:

(A) an amount of a component selected from the group consisting of secondary and tertiary amine molecules conforming to general chemical formula (I):

(I)

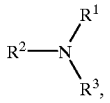

where: $R^1$ represents a moiety selected from the group consisting of monovalent moieties conforming to the general chemical formula $—CH_2—R^4$, where $R^4$ represents an α-ketonyl moiety; $R^2$ represents a moiety selected from the group consisting of abietyl, hydroabietyl, and dehydroabietyl moieties; and $R^3$ represents a hydrogen atom or a moiety conforming to the same general formula as for $R^1$, which moiety may or may not be the same as $R^1$;

(B) an amount of a component of dissolved organic compounds and polymers that contain at least two hydroxy moieties per molecule and an average of at least 0.4 hydroxy moieties per carbon atom;

(C) an amount of a component selected from the group consisting of organic molecules that contain at least one carbon-sulfur bond and are not part of any of the previously recited components (A) or (B); and (D) an amount of surfactant that is not part of any of the previously recited components (A) through (C); and, optionally, one or more of the following components:

(E) an amount of a component selected from fatty acids that have from 8 to 24 carbon atoms per molecule and are not part of any of the previously recited components (A) through (D);

(F) an amount of a component selected from organic molecules that contain both a carbon-carbon triple bond and a hydroxyl moiety in each molecule and that are not part of any of the previously recited components (A) through (E); and (G) an amount of viscosity regulating agents that are not part of any of the previously recited components (A) through (F).

One major embodiment of the invention is a concentrate inhibitor useful for adding to an aqueous neutral to alkaline chelating solution to produce a working inhibited chelating solution, which is itself a second major embodiment of the invention. A third major embodiment is a process of cleaning with such an inhibited working cleaning solution.

DESCRIPTION OF PREFERRED EMBODIMENTS

A concentrate inhibitor according to the invention is preferably liquid at 25° C. under normal ambient natural atmospheric pressure.

Preferred molecules for component (A) are set forth in detail in U.S. Pat. No. 2,758,970 of Aug. 14, 1956 to Saukaitis et al., the entire disclosure of which, except for any part thereof that may be inconsistent with any explicit statement herein, is hereby incorporated herein by reference. The single most preferred material is a commercial product, RODINE® 203 Base, available from the Henkel Surface Technologies Div. of Henkel Corp., Madison Heights, Mich., USA; this product is made as generally described in U.S. Pat. No. 2,758,970 and contains from 89 to 95% of material conforming to the requirements for component (A). Independently, the amount of component (A) present in a concentrate composition according to the invention preferably is at least, with increasing preference in the order given, 2, 4, 6, 8, 10, 12, 14.0, 15.0, 16.0, 17.0, 18.0, 19.0, or 19.5 percent of the total concentrate and independently preferably is not more than, with increasing preference in the order given, 50, 45, 40, 37, 34, 31, 29, 27, 25, 24.0, 23.0, 22.0, 21.0, or 20.5 percent of the total concentrate.

With increasing preference in the order given, at least 50, 60, 70, 75, 80, 85, 90, 95, or 99% of the mass of molecules selected for component (B) is selected from the group consisting of ethylene glycol, propylene glycol, and polyoxyalklyenes in which at least 50, 60, 70, 75, 80, 85, 90, 95, or 99% of the mass of the polyoxyethylenes consists of ethylene oxide residues. Any remaining part preferably consists of residues of alkylene oxides having no more than, with increasing preference in the order given, 5, 4, or 3 carbon atoms per molecule. Independently of other preferences, the weight average molecular weight of molecules selected for component (B) preferably is at least, with increasing preference in the order given, 65, 100, 150, 200, 250, 300, 350, 400, 450, 500, 550, or 575 daltons and independently preferably is not more than, with increasing preference in the order given, 10,000, 5000, 4000, 3000, 2000, 1500, 1000, 900, 800, 700, 650, or 625 daltons. A major disadvantage for higher molecular weight polymers for component (B) is excessive viscosity of the compositions, while lower molecular weight polymers and the two glycols are less effective in inhibition. Also, when component (B) is selected from polyoxyethylenes with a molecular weight in the range from 300 to 800, the amount of component (B) preferably has a ratio to the amount of component (A), measured in the same mass or weight units, that is at least, with increasing preference in the order given, 0.10:1.0, 0.20:1.0, 0.30:1.0, 0.35:1.0, 0.40:1.0, 0.45:1.0, 0.50:1.0, 0.52:1.0, 0.54:1.0, 0.56:1.0, 0.58:1.0, 0.60:1.0, 0.62:1.0, or 0.64:1.0 and independently preferably is not more than, with increasing preference in the order given, 4.0:1.0, 3.5:1.0, 3.0:1.0, 2.5:1.0, 2.0:1.0, 1.5:1.0, 1.0:1.0, 0.90:1.0, 0.80:1.0, 0.75:1.0, 0.70:1.0, 0.68:1.0, or 0.66:1.0. If component (B) is selected from ethylene glycol, propylene glycol, or polyoxyalkylenes with a molecular weight of not more than 200, however, then the amount of component (B) preferably has a ratio to the amount of component (A), measured in the same mass or weight units, that is at least, with increasing preference in the order given, 0.50:1.0, 0.70:1.0, 0.90:1.0, 1.10:1.0, 1.20:1.0, 1.30:1.0, 1.40:1.0, 1.50:1.0, or 1.60:1.0 and independently preferably is not more than, with increasing preference in the order given, 8.0:1.0. 6.0:1.0, 4.0:1.0, 3.5:1.0, 3.0:1.0, 2.5:1.0, 2.0:1.0, 1.8:1.0, or 1.66:1.0.

For component (C), molecules that contain at least one carbon-sulfur single bond are preferred over those, such as the former widely used but now known to be carcinogenic thiourea, that contain only double bonds between carbon and sulfur. Numerous suitable materials in which the molecules contain carbon-sulfur single bonds, such as thiodisuccinic acid, thiodiglycolic acid, and the like are known and even commercially available. Predominantly because it is highly effective and less expensive than most other commercially available materials that are suitable for component (C), the most preferred material for component (C) is BURCO™ TME surfactant, commercially supplied by Burlington Chemical Co. and reported by its supplier to consist of ethoxylated alkyl thiols. Independently of its exact chemical nature, the amount of component (C) preferably is such as to have a ratio to the amount of component (A) in the same composition according to the invention that is at least, with increasing preference in the order given, 0.02:1.0, 0.04:1.0, 0.06:1.0, 0.08:1.0, 0.10:1.0, 0.12:1.0, 0.14:1.0, 0.16:1.0, or 0.18:1.0 and independently preferably is not more than, with increasing preference in the order given, 1.5:1.0, 1.0:1.0, 0.8:1.0, 0.6:1.0, 0.40:1.0, 0.30:1.0, 0.25:1.0, 0.21:1.0, or 0.19:1.0.

Component (D) of surfactant preferably is nonionic surfactant. More preferably, component (D) consists of molecules that conform to general chemical formula II:

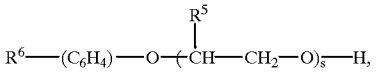

(II)

wherein $R^6$ is a linear, cyclic, or branched saturated monovalent aliphatic hydrocarbon moiety containing from 4 to 25 carbon atoms; $(C_6H_4)$ is an ortho-, meta-, or para-phenylene nucleus; s is an integer from 1 to 50, and $R^5$ represents a covalently bonded hydrogen atom or an alkyl moiety containing from 1 to 4 carbon atoms and, within this limitation, may be the same as or different from any other $R^5$ moiety in any molecule in the component. Still more preferably, these alkoxylated alkyl phenol molecules are preferably selected from molecules that conform to general formula (II) when, independently for each moiety or variable number noted: the number of carbon atoms in moiety $R^6$ is at least, with increasing preference in the order given, 4, 5, 6, 7, 8, or 9 and independently preferably is not more than, with increasing preference in the order given, 20, 18, 16, 14, 12, 10, or 9; $R^6$ is not cyclic; with increasing preference in the order given, at least 50, 60, 70, 75, 80, 85, 90, 95, or 99 number % of the $R^5$ moieties in the component are hydrogen; and the average value of s for the component is at least, with increasing preference in the order given, 8, 10, 12, 14, 16, 18, or 19.3 and independently preferably is not more than, with increasing preference in the order given, 50, 45, 40, 35, 30, 28, 26, 24, 22, or 20.7. A variety of commercial surfactants that satisfy these preferences to varying degrees are readily available. Independently of other preferences, the amount of component (D) in any composition according to the invention preferably is such as to have a ratio to the amount of component (A) in the same composition that is at least, with increasing preference in the order given, 0.10:1.0, 0.20:1.0, 0.30:1.0, 0.40:1.0, 0.50:1.0, 0.60:1.0, 0.70:1.0, 0.75:1.0, 0.80:1.0, 0.83:1.0, 0.86:1.0, 0.89:1.0, or 0.91:1.0 and independently preferably is not more than, with increasing preference in the order given, 5.0:1.0, 4.0:1.0, 3.0:1.0, 2.5:1.0, 2.0:1.0, 1.8:1.0, 1.6:1.0, 1.4:1.0, 1.2:1.0,1.0:1.0, 0.96:1.0, 0.94:1.0, or 0.92:1.0.

When used, optional fatty acid component (E) is preferably selected from molecules in which the number of carbon atoms is at least, with increasing preference in the order given, 12, 14, 16, or 18 and independently preferably is not more than, with increasing preference in the order given, 22, 20, or 18. Independently, with increasing preference in the order given, at least 25, 40, 65, 70, 80, 85, 90, or 95 number % of the molecules in component (E) have at least one carbon-carbon double bond per molecule; and, independently, the number % of molecules in component (E) that have two or more carbon-carbon double bonds per molecule is at least, with increasing preference in the order given, 10, 20, 25, 30, 35, 40, or 45 and independently preferably is not more than, with increasing preference in the order given, 80, 70, 60, 55, or 50. Independently of its exact chemical characteristics, the amount of component (E) in a composition according to the invention preferably is such as to have a ratio to the amount of component (A) that is at least, with increasing preference in the order given, 0.05:1.0, 0.10:1.0, 0.15:1.0, 0.20:1.0, 0.25:1.0, 0.30:1.0, 0.35:1.0, 0.40:1.0, 0.45:1.0, or 0.50:1.0 and independently preferably is not more than, with increasing preference in the order given, 2.0:1.0, 1.5:1.0, 1.0:1.0, 0.90:1.0, 0.85:1.0, 0.80:1.0, 0.75:1.0, 0.70:1.0, 0.65:1.0, 0.60:1.0, or 0.55:1.0.

Optional component (F) is normally preferably present in a composition according to the invention, and when present preferably has a ratio to component (A) that is at least, with increasing preference in the order given, 0.014:1.0, 0.020:1.0, 0.040:1.0, 0.070:1.0, 0.080:1.0, 0.090:1.0, 0.100:1.0, 0.110:1.0, 0.120:1.0, or 0.130:1.0 and independently preferably is not more than, with increasing preference in the order given, 1.0:1.0, 0.8:1.0, 0.6:1.0, 0.50:1.0, 0.40:1.0, 0.30:1.0, 0.25:1.0, 0.20:1.0, 0.18:1.0, 0.16:1.0, or 0.140:1.0. Independently the materials preferably have low toxicity, unlike propargyl alcohol which was traditionally used in acid pickling inhibitors. Preferred examples include 3methyl-1-butyn-3-ol and 2-ethyl octynol, with the latter more preferred.

Some of the necessary components of a composition according to this invention, particularly components (A) and (B), contribute to high viscosity when dissolved in water. If this viscosity is objectionable, the use of optional viscosity regulating component (G) will be preferred. Any of the completely water miscible alcohols, i.e., methanol, ethanol, 1- and 2-propanol, and 2-methyl-2-butanol, may be effectively used for this purpose, with 2-propanol or propylene glycol generally preferred. The minimum amount needed to reduce the viscosity to the desired level is normally preferred; this is usually from 4 to 8% of the total amounts of components (A) and (B) in the composition. Dissolved ammonia has also been found to be effective for this purpose, and may be preferred if the small flammability risk of the alcohols is considered unacceptable. As with alcohol, at least in part for economy, the minimum amount required to reduce the viscosity to an acceptable level is generally preferred. An amount of dissolved ammonia equal to 3 to 6% of the total amount of components (A) and (B) is generally sufficient and therefore preferred.

In working cleaning compositions and in cleaning processes according to this invention, constituents other than the inhibitor and most operating conditions preferably are the same as corresponding constituents and operating conditions generally known in the prior art. A working cleaning solution according to this invention preferably contains an amount of inhibitor according to the invention so that the concentration of component (A) in the working composition is 0.1% of the preferred amounts noted above for component (A) in a concentrate composition. Suitable but non-limiting operating conditions are given in S. Pocock and W. S. Leedy, "Chemical Cleaning Research for Nuclear Steam Generators", *Proceedings of the* 32$^{nd}$ *International Water Conference* (Engineers Society of Western Pennsylvania, Pittsburgh, 1972), pp. 67–79 and R. Roberge and R. Gilbert, "Inhibition of Carbon Steel Corrosion in Chemical Cleaning Solutions Containing Solid Magnetite", *Corrosion—NACE,* 1983, pp. 496–501. The entirety of both of these documents, except for any part inconsistent with any explicit statement herein, is hereby incorporated herein by reference.

The invention is particularly advantageously applicable to use with cleaning solutions that, in addition to the inhibitor and water, comprise, or preferably consist essentially of, salts of ethylene diamine tetraacetic acid (hereinafter usually abbreviated as "EDTA") with ammonia, hydrazine, or amines in amounts from 0.5 to 20% of the total working cleaning solution. More preferably, the percentage of such salts in a working cleaning composition according to this invention is at least, with increasing preference in the order given, 1.0, 1.5, 2.0, 2.5, 3.0, 3.5, or 4.0% and independently preferably is not more than, with increasing preference in the order given, 15,10, 8.0, 7.5, 7.0, 6.5, 6.0, 5.0, or 4.5%. Other common constituents of working compositions that do not change the basic and fundamental nature of the inventions described herein include fluoride ions, which often accelerate the speed of dissolution of ferriferous scale, and oxidizing agents, which accelerate the removal of copper containing scale. (Copper containing scale is often found even on surfaces to be cleaned that do not contain any significant amount of copper, because the water circulating through a boiler or similar equipment often dissolves copper from other parts of the equipment that it contacts during such circulation. When such water contacts a more electrochemically active ferriferous surface, at least some of the copper content can be deposited on the ferriferous surface by "displacement plating", i.e., the dissolution of an amount of iron as cations to balance the electric charge of the copper cations converted at the surface to elemental form. Once it has been deposited, the elemental copper can itself react to form oxides and other types of scale.)

A process according to the invention comprises, at a minimum, contacting a metal workpiece to be cleaned with a working cleaning solution according to the invention as described above. As already noted above, operating conditions are generally preferably the same as with otherwise similar cleaning compositions inhibited with prior art inhibitors. For cleaning boiler tubes or other workpieces that are designed to operate under pressure, preferred conditions, as in the prior art, include a temperature above the boiling point of water, to speed the dissolution process. For example, for removing deposits in which the major metallic constituent is iron, the temperature preferably is, with increasing preference in the order given, at least 103, 108, 113, 118, 123, 128, or 133° C. and independently preferably is, with increasing preference in the order given, not more than 149, 145, 141, or 138° C. However, compositions according to the invention may also be used at a lower temperature, particularly one below the boiling point of the composition, and such use may be more economical, even though longer contact times will usually be required, for cleaning objects not themselves suited to contain pressures in excess of atmospheric pressure. The gas in equilibrium with the liquid cleaning composition preferably is supplied only by vaporization of the sufficiently volatile constituents of the cleaning solution, without the addition of any other gas.

The time during which the workpiece is in contact with a cleaning composition according to this invention during a process according to this invention preferably is sufficient to remove scale and other bulk oxide coatings from the workpiece surface, a time which naturally varies considerably under the influence of such factors as the exact composition of the scale to be removed, the thickness of the scale and of any other soil to be removed, the temperature(s) maintained during contact, and the specific chemical nature(s) of the scale and/or other soil to be removed. Under many common operating conditions, the time of contact at preferred temperature preferably is at least, with increasing preference in the order given, 1.0, 2.0, 3.0, 3.5, 4.0, 4.5, 5.0, or 5.5 hours and independently preferably is not more than 24, 16, 13, 10, 8.0, 7.5, 7.0, 6.5, or 6.0 hours. Contact between the workpiece and the working cleaning composition is generally by immersion, or, if the surface to be cleaned defines a hollow space that can function as a liquid container, by filling this container with the cleaning composition to at least a sufficiently high level to contact all of the scale and/or other soil desired to be removed. Any process of establishing the requisite contact, such as those known per se in the art, may be used.

The practice and benefits of the invention may be further appreciated by consideration of the following non-limiting examples.

Examples of Concentrated Inhibitors and Working Cleaning Compositions

Concentrations in concentrated inhibitor compositions of any components present other than water are shown in Table 1; water was the balance of the concentrate.

Testing of Degree of Inhibition Achieved

Concentrated Inhibitor Composition 2 (from Table 1) was not further tested, because it was so viscous as to make it almost impossible to weigh out any precisely predetermined amount of it. The other Compositions in Table 1 were tested for the corrosion inhibiting effectiveness. For these tests, the inhibitors were added to a stock solution in water of 4% of tetra-ammonium ethylene diamine tetra-acetate (generated in situ by successive additions of EDTA and aqueous ammonia) in an amount that results in a concentration of the inhibitor concentrate in the working cleaning solution as shown in Table 2.

Conventional and precisely weighed corrosion test specimens of Type 1020 Cold Rolled Steel (hereinafter usually abbreviated as "CRS") and/or Monel Metal 400 were immersed in this solution, with inhibitor added as noted below, in a pressure-tight autoclave. The working cleaning solution was then brought to a temperature of 149° C. and maintained at that temperature and in contact with the immersed test specimens for 24 hours. After this time, the autoclave and its contents were cooled and then opened to the atmosphere. The test specimens were then removed from contact with the cleaning composition, rinsed with water, dried and weighed. Corrosion rates in grams per square centimeter per day were then calculated from the thus-determined difference in mass before and after exposure, the known surface area of the test specimen, and the time of exposure, in the usual manner well known to those skilled in the art. Results, which are averages of duplicate specimens, are given in Table 2.

TABLE 1

| Ingredient as Used | Percent of Ingredient in Composition Number: 1 | 2 | 3 | 4 | 5 | 6 | 7 | 8 |
|---|---|---|---|---|---|---|---|---|
| RODINE ® 203 Base | 20 | 20 | 20 | 20 | 20 | 18 | 12 | 20 |
| POLYGLYCOL ™ E-600 polyoxyethylene | 12 | 12 | 12 | 12 | 10 | 9.3 | 15 | — |
| BURCO ® TME ethoxylated thiols | 3.4 | — | 3.4 | — | — | — | — | — |
| Thiodisuccinic acid | — | 3.5 | — | — | — | — | — | — |
| Cysteine | — | — | — | 3.5 | — | — | — | — |
| Mercaptosuccinic acid | — | — | — | — | 5 | — | 6 | — |
| N,N'-dibutyl thiourea | — | — | — | — | — | 4.6 | — | — |
| 2-Thiobenzoic acid | — | — | — | — | — | — | — | 6.0 |
| IGEPAL ™ CO-850 surfactant | 17 | — | 17 | 16 | 10 | 9.3 | 10 | 10 |
| ETHODUOMEEN ™ T/13 surfactant | — | 4.0 | — | — | — | — | — | — |
| EXXON ™ PA-14 | — | — | — | — | — | 10 | 10 | — |
| PAMAK ® 4A Fatty Acid | 10 | 10 | 10 | 10 | — | — | 5.0 | — |
| Lauric acid | — | — | — | — | 5.0 | 4.6 | — | — |
| 2-Ethyl octynol | 2.5 | 2.5 | 2.5 | 2.5 | 2.0 | 1.8 | — | — |
| 2-Propanol | 2.0 | — | — | 8.0 | — | 7.4 | — | — |
| Propylene glycol | — | — | — | — | — | — | — | 30 |
| Triethanol amine | — | — | — | — | — | — | 5.0 | — |
| Aqueous ammonia, 29.9% $NH_3$ | — | — | 5.1 | — | — | — | — | — |

Notes for Table 1

A hyphen in a cell of the table means that the corresponding ingredient was not used in the composition in question.

POLYGLYCOL ™ E-600 hydroxyl-terminated polyoxyethylene was obtained commercially from Dow Chemical Co. and is reported by its supplier to have a weight average molecular weight of 600.

IGEPAL ™ CO-850 surfactant was obtained commercially from Rhône-Poulenc and is reported by its supplier to consist of adducts of ethylene oxide with nonyl phenol, with an average of 20 ethylene oxide residues per molecule.

ETHODUOMEEN ™ T/13 surfactant was obtained commercially from Akzo Nobel, Inc. and is reported by its supplier to consist of adducts of ethylene oxide with (i) N-tallow alkyl trimethylene diamines or (ii) N-tallow alkyl primary amines.

PAMAK ® 4A Fatty Acid was obtained commercially from Hercules Inc., Resins Group, and is reported by its supplier to be a product of fractional distillation of tall oil and to consist of 48% of oleic acid, 43% of linoleic acid, 3% of saturated fatty acids, not more than 4% of rosin acids, with the balance of unknown chemical nature.

EXXON ™ PA-14 was supplied commercially by Exxon Chemical Co. and is reported by its supplier to be a mixture of primary amines with an average of about 14 carbon atoms per molecule.

TABLE 2

| Inhibitor Number (from Table 1) | Percent of Inhibitor in Cleaning Solution | For 1020 CRS: Weight Loss, g/cm²/day | For 1020 CRS: Percent Inhibition | For Monel 400: Weight Loss, g/cm²/day | For Monel 400: Percent Inhibition |
|---|---|---|---|---|---|
| 1 | 0.10 | 0.03 | 99 | 0.01 | 79 |
| 1 | 0.050 | 0.21 | 89 | 0.01 | 79 |
| 1 | 0.10* | 0.04 | 98 | <0.01 | 84 |
| 3 | 0.10 | 0.04 | n.m. | n.m. | n.m. |
| 4 | 0.10 | 0.001 | 98 | 0.001 | 30 |
| 5 | 0.10 | <0.001 | 99+ | <0.001 | 83 |
| 6 | 0.10 | <0.001 | 99 | <0.001 | 87 |
| 7 | 0.10 | 0.001 | 98 | <0.001 | 58 |
| 8 | 0.10 | <0.001 | 99 | <0.001 | 80 |

Notes for Table 2

*In this instance, the cleaning solution also contained sufficient ferrous sulfate heptahydrate to correspond to 3.0 parts of ferrous cations per thousand parts by weight of total composition. (The ferrous cations were added to make the corrosion testing relate more closely to practical operating conditions, in which much of the total content of EDTA will be chelated to iron introduced into the cleaning composition by dissolution of scale.)

"n.m." means "not measured"; "g/cm²/day" means "total grams of metal lost in one day of exposure to the composition, divided by the area of the workpiece in square centimeters", usually as calculated on the basis of actual mass loss during some time interval different from one day on the assumption of a constant corrosion rate.

I claim:

1. A concentrate inhibitor composition having a total mass, comprising:

(A) a mass of a component selected from the group consisting of secondary and tertiary amine molecules conforming to the chemical formula (I):

(I)

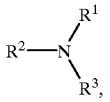

where: $R^1$ represents a moiety selected from the group consisting of monovalent moieties conforming to the chemical formula —$CH_2$—$R^4$, where $R^4$ represents an α-ketonyl moiety; $R^2$ represents a moiety selected from the group consisting of abietyl, hydroabietyl, and dehydroabietyl moieties; and $R^3$ represents a hydrogen atom or a moiety conforming to $R^1$, which moiety may or may not be the same as $R^1$, where the mass of component (A) is from about 2% to about 50% by weight of the total mass of said concentrate inhibitor composition;

(B) a mass of a component selected from the group consisting of organic compounds and polymers that contain at least two hydroxy moieties per molecule of said component and an average of at least 0.4 hydroxy moieties per carbon atom, where the mass of component (B) has a ratio to the mass of component (A) that is from about 0.10:1.0 to about 8.0:1.0 by weight;

(C) a mass of a component selected from the group consisting of organic molecules that contain at least one carbon-sulfur bond and are not part of any of the previously recited components (A) or (B), where the mass of component (C) has a ratio to the mass of component (A) that is from about 0.02:1.0 to about 1.5:1.0 by weight; and (D) a mass of surfactant that is not part of any of the previously recited components (A) through (C), where the mass of component (D) has a ratio to the mass of component (A) that is from about 0.10:1.0 to about 5.0:1.0 by weight.

2. The concentrate inhibitor composition according to claim 1, wherein: the mass of component (A) is from about 6% to about 50% by weight of the total mass of said concentrate inhibitor composition; at least 80% by weight of the mass of component (B) is selected from polyoxyethylenes with a weight average molecular weight in the range of 300 to 800 daltons; the mass of component (B) has a ratio to the mass of component (A) that is from about 0.30:1.0 to about 2.5:1.0 by weight; the mass of component (C) has a ratio to the mass of component (A) that is from about 0.06:1.0 to about 1.5:1.0 by weight; and the mass of component (D) has a ratio to the mass of component (A) that is from about 0.30:1.0 to about 3.0:1.0 by weight.

3. The concentrate inhibitor composition according to claim 1, wherein the mass of component (A) is from about 15% to about 24.0% by weight of the total mass of said concentrate inhibitor composition; at least 90% by weight of the mass of component (B) is selected from the group of polyoxyethylenes with a weight average molecular weight from about 400 to about 800 daltons; the mass of component (B) has a ratio to the mass of component (A) that is from about 0.50:1.0 to about 0.75:1.0 by weight; the mass of component (C) has a ratio to the mass of component (A) that is from about 0.14:1.0 to about 0.30:1.0 by weight; and the mass of component (D)) has a ratio to the mass of component (A) that is from about 0.75:1.0 to about 1.4:1.0 by weight.

4. The concentrate inhibitor composition according to claim 1, wherein: at least 60% by weight of component (B) is selected from ethylene glycol and propylene glycol; the mass of component (A) is from about 6% to about 50% by weight of the total mass of said concentrate inhibitor composition; the mass of component (B) has a ratio to the mass of component (A) that is from about 0.90:1.0 to about 3.5:1.0 by weight; the mass of component (C) has a ratio to the mass of component (A) that is from about 0.06:1.0 to about 1.5:1.0 by weight; and the mass of component (D) has a ratio to the mass of component (A) that is from about 0.30:1.0 to about 3.0:1.0 by weight.

5. The concentrate inhibitor composition according to claim 1, wherein: at least 90% by weight of component (E) is propylene glycol; the mass of component (A) is from about 15% to about 24% by weight of the total mass of said concentrate inhibitor composition; the mass of component (B) has a ratio to the mass of component (A) that is from about 1.10:1.0 to about 2.5:1.0 by weight; the mass of component (C) has a ratio to the mass of component (A) that is from about 0.14:1.0 to about 0.30:1.0 by weight; and the mass of component (D) has a ratio to the mass of component (A) that is from about 0.75:1.0 to about 1.4:1.0 by weight.

6. The process of cleaning a soiled metal surface by contacting said soiled metal surface with an aqueous solution of said concentrate inhibitor composition according to claim 1, said aqueous solution comprising from about 0.002 to about 0.050% by weight of component (A) of said concentrate inhibitor composition according to claim 1.

7. The process of cleaning a soiled metal surface by contacting a soiled metal surface with an aqueous solution in water of said concentrate inhibitor composition according to claim 1, said aqueous solution comprising from about 0.002 to about 0.050% by weight of component (A) of said concentrate inhibitor composition according to claim 1.

8. The concentrate inhibitor composition of claim 1, said composition further comprising a component selected from the group consisting of:

(E) a mass of a component selected from fatty acids that have from 8 to 24 carbon atoms per molecules of said component and are not part of any of the previously recited components (A) through (D);

(F) a mass of a component selected from organic molecules that contain both carbon-carbon triple bond and a hydroxyl moiety in each molecule of said component and that are not part of any of the previously recited components (A) through (E); and (G) a mass of a viscosity regulating agent that is not part of any of the previously recited components (A) through (F) wherein said viscosity regulating agent is selected from the group consulting of water miscible alcohols and ammonia.

9. A process of cleaning a soiled metal surface by contacting said soiled metal surface with an aqueous solution of said concentrate inhibitor composition according to claim 5, said aqueous solution comprising from about 0.015 to about 0.024% by weight of component (A) of said concentrate inhibitor composition according to claim 6.

10. A process of cleaning a soiled metal surface by contacting said soiled metal surface with an aqueous solution of said concentrate inhibitor composition according to claim 4, said aqueous solution comprising from about 0.006 to about 0.050% by weight of component (A) of the concentrate inhibitor composition according to claim 5.

11. A process of cleaning a soiled metal surface by contacting said soiled metal surface with an aqueous solution of said concentrate inhibitor composition according to claim 3, said aqueous solution comprising from about 0.015 to about 0.024% by weight of component (A) of said concentrate inhibitor composition according to claim 4.

12. A process of cleaning a soiled metal surface by contacting said soiled metal surface with an aqueous solution of said concentrate inhibitor composition according to claim 2, said aqueous solution comprising from about 0.06 to about 0.050% by weight of component (A) of said concentrate inhibitor composition according to claim 3.

13. The process of claim 6, wherein said aqueous solution also comprises from about 2.0 to about 7.5% by weight of salts of EDTA with ammonia, hydrazine, or amines.

14. The process of claim 7, wherein said aqueous solution also comprises from about 1.0 to about 15% by weight of salts of EDTA with ammonia, hydrazine, or amines.

15. The process according to claim 9, wherein said aqueous solution of said concentrate inhibitor composition also comprises from about 3.5 to about 5.0% by weight of salts of EDTA with ammonia, hydrazine, or amines.

16. The process according to claim 10, wherein said aqueous solution also comprises from about 3.0 to about 6.0% by weight of salts of EDTA with ammonia, hydrazine, or amines.

17. The process according to claim 11, wherein said aqueous solution also comprises from about 3.5 to about 5.0% by weight of salts of EDTA with ammonia, hydrazine, or amines.

18. The process according to claim 12, wherein said aqueous solution also comprises from about 3.0 to about 6.0% by weight of salts of EDTA with ammonia, hydrazine, or amines.

19. The process according to claim 14, wherein said soiled metal surface to be cleaned is part of a pressurizable container, a principal metallic constituent of the soil to be removed is iron, and a temperature dung contact between said aqueous solution and said soiled metal surface is at least about 103° C.

20. The process according to claim 15, wherein the soiled metal surface to be cleaned is part of a pressurizable container, the principal metallic constituent of the soil to be removed is iron, and the temperature during contact between said aqueous solution of said concentrate inhibitor composition and the soiled metal surface is at least about 123° C.

* * * * *

UNITED STATES PATENT AND TRADEMARK OFFICE

CERTIFICATE OF CORRECTION

PATENT NO. : 6,344,090 B1
DATED : February 5, 2002
INVENTOR(S) : Johnston

It is certified that error appears in the above-identified patent and that said Letters Patent is hereby corrected as shown below:

Column 11,
Line 12, after "wherein", insert -- : --
Line 21, delete "(D))", and insert therefor -- (D) --
Line 37, delete "(E)", and insert therefor -- (B) --
Line 67, after "both", insert -- a --

Column 12,
Line 14, delete "6", and insert therefor -- 5 --
Line 19, delete "5", and insert therefor -- 4 --
Line 25, delete "4", and insert therefor -- 3 --
Line 31, delete "3", and insert therefor -- 2 --
Line 57, delete "dung", and insert therefor -- during --

Signed and Sealed this

Fifth Day of July, 2005

JON W. DUDAS
*Director of the United States Patent and Trademark Office*